United States Patent [19]

Beck

[11] Patent Number: 4,751,834

[45] Date of Patent: Jun. 21, 1988

[54] DOOR LOCK GUARD DEVICE

[76] Inventor: Donald D. Beck, 2262 E. Javelina, Mesa, Ariz. 85204

[21] Appl. No.: 79,445

[22] Filed: Jul. 30, 1987

[51] Int. Cl.[4] ..... E05B 15/02

[52] U.S. Cl. ..... 70/452; 70/417; 70/418; 70/451; 70/DIG. 63; 292/346

[58] Field of Search ..... 70/134, 370, 371, 451, 70/452, 417, 418, DIG. 63, DIG. 64; 292/346

[56] References Cited

U.S. PATENT DOCUMENTS

| | | | |
|---|---|---|---|
| 631,431 | 8/1899 | Phelps . | |
| 695,472 | 3/1902 | Miller . | |
| 1,122,224 | 12/1914 | Weissberg | 70/DIG. 63 |
| 3,559,877 | 2/1971 | Greenwald | 70/DIG. 63 |
| 3,645,045 | 2/1972 | Gervis et al. | 49/504 |
| 3,698,217 | 10/1972 | Roy | 70/451 |
| 3,761,119 | 9/1973 | Bennett et al. | 292/346 |
| 3,963,269 | 6/1976 | Rosenberg | 292/346 |
| 4,074,552 | 2/1978 | Smith | 70/417 |
| 4,229,956 | 10/1980 | Thorburn | 70/DIG. 63 |
| 4,237,712 | 12/1980 | Cramer | 70/417 |
| 4,316,371 | 2/1982 | Del Nero | 70/417 |
| 4,484,463 | 11/1984 | Hennessy | 70/452 |
| 4,570,467 | 2/1986 | Greco | 292/346 |

FOREIGN PATENT DOCUMENTS

| | | | |
|---|---|---|---|
| 289534 | 4/1928 | United Kingdom | 70/DIG. 63 |

*Primary Examiner*—Robert L. Wolfe
*Attorney, Agent, or Firm*—LaValle D. Ptak

[57] ABSTRACT

A guard plate is used to protect a door from forced entry where the door is used in conjunction with a doorjamb. The door has a lock cylinder in it, and this cylinder is operatively interconnected with a reciprocal bolt for entering an opening in the doorjamb in a conventional manner. The guard plate has first and second interconnected sections. An opening is provided through the first section for accommodating the portion of the lock cylinder which normally is exposed on the surface of the door in which the cylinder is mounted. The first section of the plate then is secured to the door, with the lock cylinder aligned with the opening in the first section. The second section also has an opening through it, and the two sections are interconnected together with a bridge. The bridge causes the second section of the plate to overlie the doorjamb when the door is closed, and the bridge itself overlies the space between the door and the doorjamb when the door is in its closed position. An auxiliary securing device is mounted in the opening in the second section, and this device releasably secures the second section to the doorjamb independently of operation of the lock cylinder. When the second section is secured to the doorjamb, by the auxiliary securing means, the door cannot be opened, irrespective of the condition of operation of the reciprocal bolt.

19 Claims, 2 Drawing Sheets

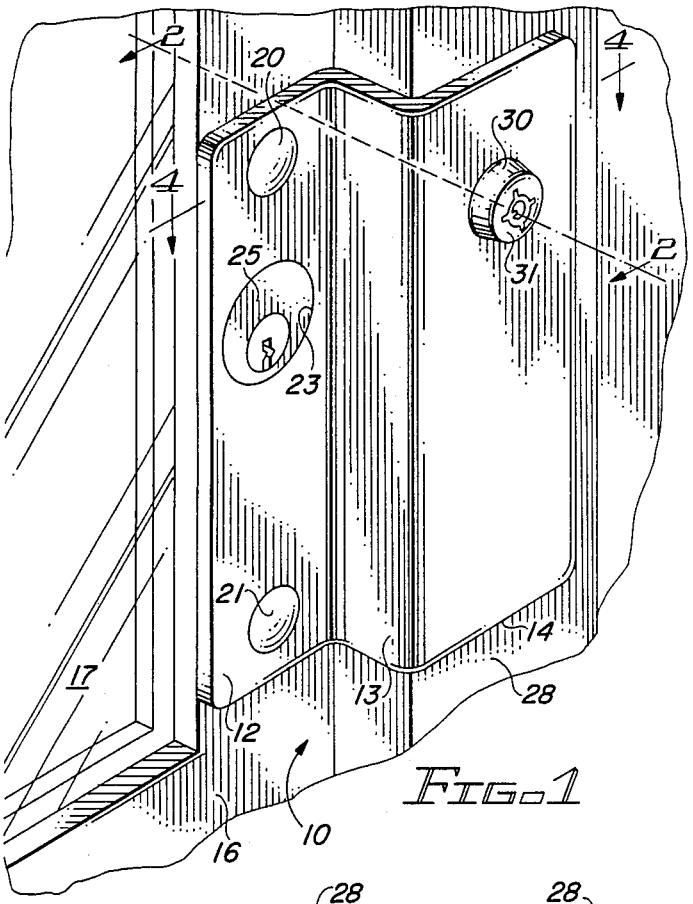
FIG. 1
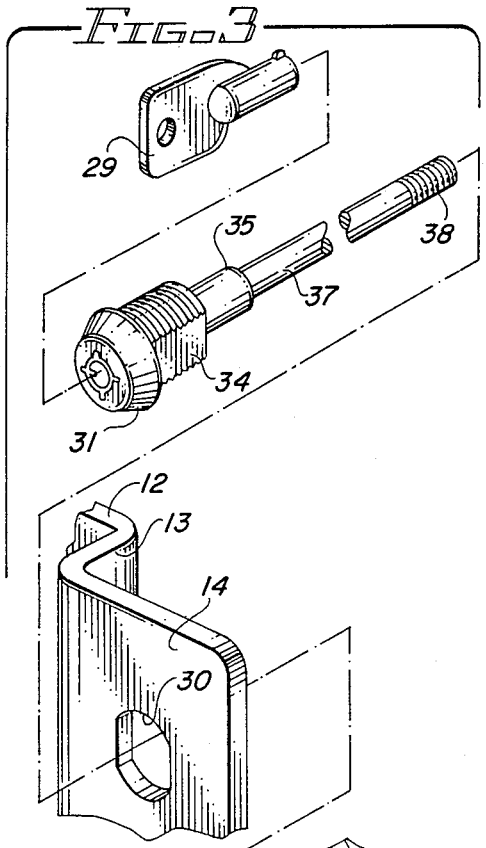
FIG. 3
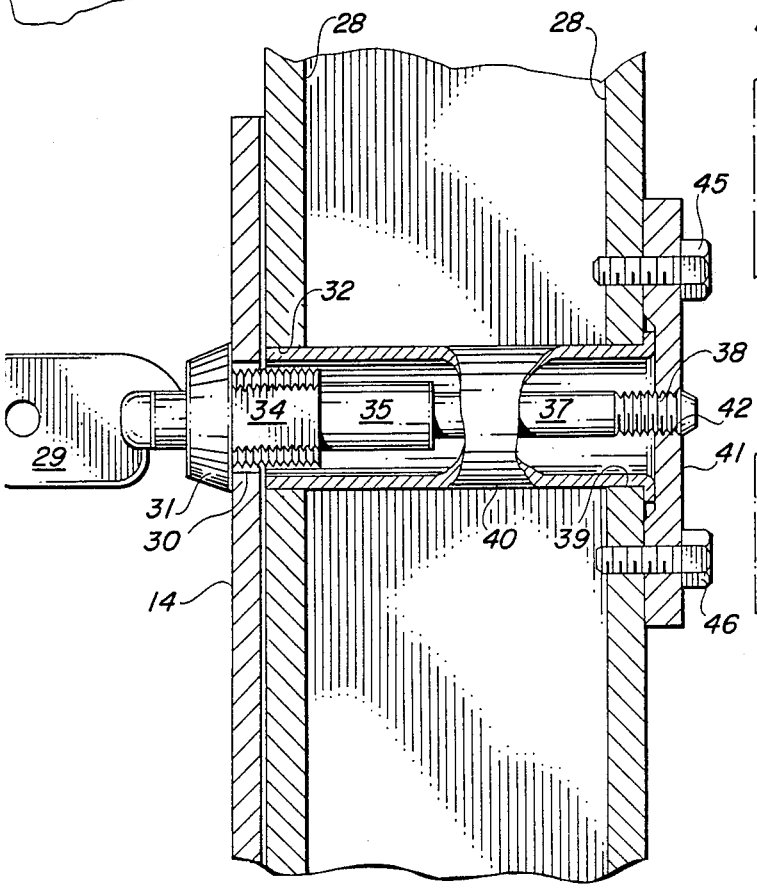
FIG. 2
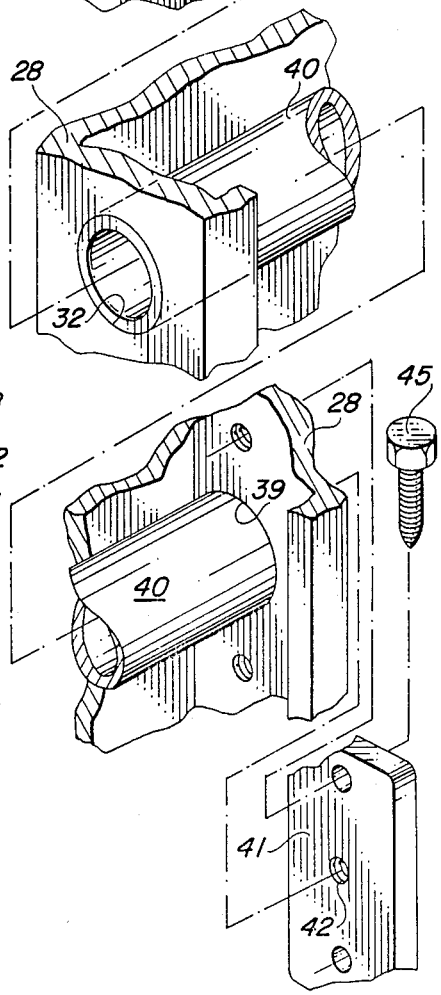

DOOR LOCK GUARD DEVICE

BACKGROUND

Narrow stile metal doors of the type commonly used in retail stores and other commercial establishments typically have a minimum amount of metal frame around a central glass portion. This is done to provide an inviting and open look to the entry of the establishment, whether a single door is used or a set of double doors is employed. Such doors are highly susceptible to forceable unauthorized entry. Burglars prefer not to break the glass and rarely enter through the glass, because of the significant danger of severe injury which is possible when the glass shatters. In addition, many doors of this type use tempered glass which is difficult to break. The doors, however, are inherently weak at the point where the bolt enters the strike hole in the doorjamb. Burglars frequently employ crowbars or pry bars to rip out the strike hole or bend the door and doorjamb at the strike hole to open the door, even when the bolt is in its extended position. In many cases, this can be accomplished with relatively little effort and in an extremely short period of time.

Such commercial doors also frequently are made of aluminum, which is a relatively soft or easily bent metal. The lock cylinders can be pried or twisted out of the door, using conventional tools available in any hardware store or home workshop. In addition, the door may be drilled to trip the deadlocking mechanism for the lock. In some cases where the gap between the door and the doorjamb or between a pair of doors (where double doors are used) is relatively wide, and this occurs frequently, the door and doorjamb can be spread sufficiently in the area of the bolt to permit the door to be opened, again without removing or retracting the extended bolt. Unfortunately, burglaries of commercial establishments are constantly increasing; so that it is important to provide a lock for such doors while, at the same time, retaining the open appearance which is provided by the large glass inserts normally used.

A relatively simple door protector device for inhibiting the spreading apart of the door and doorjamb and for providing protection over the area where the lock bolt enters the doorjamb is disclosed in the patent to Bennett U.S. Pat. No. 3,761,119. This comprises a protective plate which is fastened through carriage bolts onto the door and which extends over the space between the door and doorjamb. A pair of studs or pins also extend into holes in the doorjamb when the door is closed. The studs are secured to the face of the plate to project inwardly into the holes in the doorjamb. Thus, when the door is closed and locked in place, access to the bolt is prevented by the plate which overlies the bolt. The pins and carriage bolts which hold the plate onto the doorjamb and the door, respectively, prevent the doorjamb from being forced apart from the door in the area of the bolt. While this device provides a relatively good degree of protection, the knob or lock on the door is exposed; and a burglar with a knowledge of the construction of the device could pry the portion overlying the doorjamb away from the doorjamb, thereby defeating the purpose of the studs, unless the plate is made of extremely rigid material to prevent bending. Another door lock guard which is similar to the one of Bennett patent is disclosed in the patent to Hennessy U.S. Pat. No. 4,484,463. This device also comprises a plate which covers the space where the bolt extends between the door and doorjamb to prevent access to the bolt through this space. The plate has a thick center portion with a hole in it adapted to fit over the lock cylinder, so that access to the lock cylinder is prevented. This minimizes the potential for removal of the lock cylinder from the door. Carriage bolts or the like are used to fasten the plate to the door, but there is no provision in this patent for any physical holding of the plate onto the doorjamb.

One of the earliest examples of a plate which extends over the area of the bolt and which engages the doorjamb is disclosed in the patent to Miller U.S. Pat. No. 695,472. An escutcheon plate extends around the key opening and over the space between the door and the doorjamb to overlap the doorjamb. A projection is provided on the back surface of the escutcheon plate to engage a mating hole in the doorjamb when the door is closed and locked. This prevents the prying apart of the door from the doorjamb; and the plate itself covers the area where the bolt is; so that access to the bolt also is prevented by the plate.

Other approaches to making locks burglar resistant are directed to protective plates which extend over the lock cylinder or the area in which the lock cylinder is mounted on the door. Typically these plates are made of treated metal which is resistant to drilling and have thicknesses selected to prevent potential burlgars from having any direct contact with the edges of the lock cylinder to make it more difficult to remove the lock cylinder from the door.

For those prior art devices which protect the lock cylinder, but leave the opening between the door and the doorjamb unprotected, practically no protection from a burglar with a pry bar exists for most commercial business doors, since the door itself can be pried away from the doorjamb in the manner described previously. For those devices which include pins extending into the doorjamb, it is necessary to make the guard plate of expensive, high strength, treated stainless steel or the like for the plate to be effective. If this is not done, it is possible to pry the guard plate away from the doorjamb and then proceed as if the plate was not in place to separate the doorjamb from the door or to remove the strike hole from the doorjamb. Such plates are relatively difficult to manufacture and machine and are relatively expensive.

It is desirable to provide a door lock guard device which overcomes all of the shortcomings of the prior art and which significantly increases the degree of protection provided, by positively interlocking the door and doorjamb through the guard plate, irrespective of the condition of operation of the primary locking bolt.

SUMMARY OF THE INVENTION

It is an object of this invention to provide an improved door lock guard for inhibiting forced entry.

It is another object of this invention to provide an improved door lock guard which protects the lock cylinder, locking bolt, strike hole and doorjamb of a door against removal, damage or destruction, as a result of an attempted forced entry.

It is an additional object of this invention to provide a door guard device which positively interlocks the door and doorjamb in the region of the locking bolt to substantially inhibit or prevent forced entry.

It is a further object of this invention to provide a door guard device which is inexpensive, simple to install, and difficult to defeat in the event of an attempted forced entry.

In accordance with a preferred embodiment of the invention, a guard is provided for protecting a door from forced entry where the door is used in conjunction with a doorjamb. Such a door typically has a lock cylinder operatively interconnected with a reciprocal bolt which enters an opening or strike hole in the doorjamb. The guard comprises a metal plate having first and second interconnected sections which may be offset from one another in different planes, depending upon the manner in which the door and doorjamb are arranged. There is an opening in the first section for accomodating the portions of the lock cylinder which are exposed on the surface of the door in which the lock cylinder is mounted. The first section is secured to the door with the lock cylinder aligned with the opening in the first section. The second section of the plate is arranged to overlie the doorjamb when the door is closed; and the two sections are interconnected by a bridging section which overlaps the space between the door and the doorjamb when the door is closed. The second section also has an opening through it, and an auxiliary securing device is mounted in the opening in the second section to releasably secure the second section to the doorjamb independently of the operation of the lock cylinder.

BRIEF DESCRIPTION OF THE DRAWINGS

FIG. 1 is a perspective view of a preferred embodiment of the invention;

FIG. 2 is a cross section taken along the line 2—2 of FIG. 1;

FIG. 3 is an exploded view of the portion of the embodiment shown in FIG. 2;

DETAILED DESCRIPTION

Figure 4:
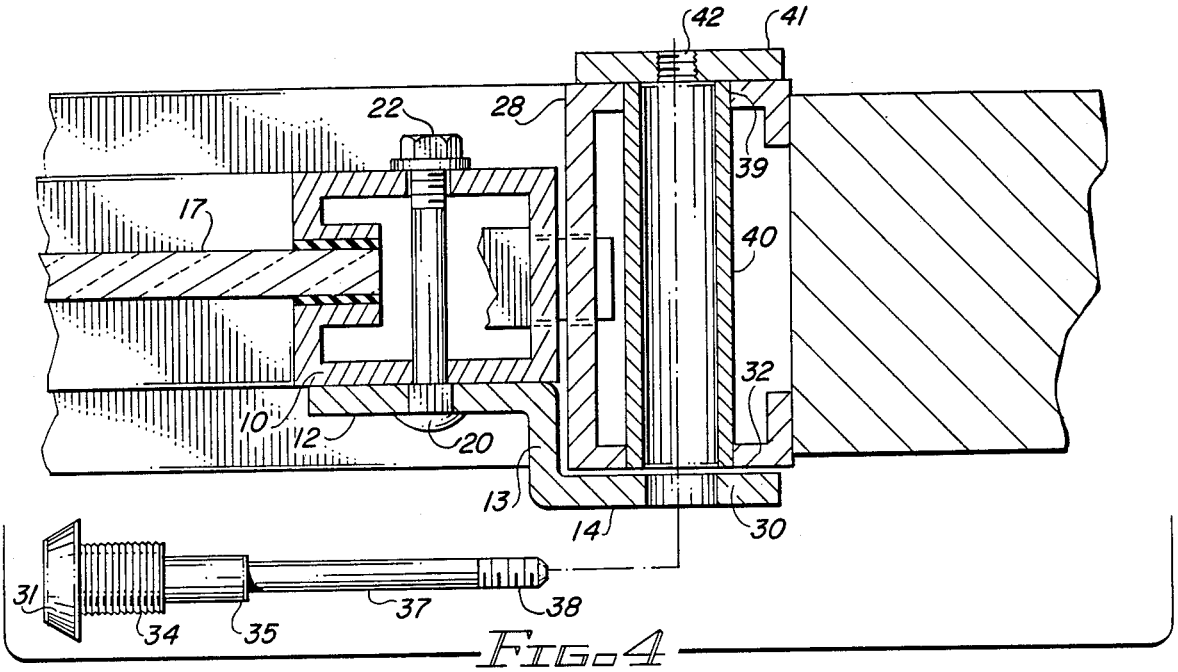
FIG. 4 is a cross section taken along the line 4—4 of FIG. 1.

Reference now should be made to the drawings in which the same reference numbers are used throughout the different figures to designate the same or similar components. The term "doorjamb" as used herein also is to be defined as a second door of a double door set, as well as, the doorjamb associated with a single door.

FIGS. 1 through 4 illustrate the details of a preferred embodiment of the invention in the form of a combination protective latch and cylinder guard for a door and the doorjamb adjacent the strike hole for the lock bolt. The device comprises a plate 10, having a first section 12 in the form of an elongated rectangle interconnected by a bridging section 13 with an offset second section 14, also in the form of an elongated rectangle. As illustrated in FIG. 1, the sections 12 and 14 are in parallel planes and overlie, respectively, the door frame and the doorjamb in the area of the strike hole. The section 13 is perpendicular to the two sections 12 and 14 and interconnects them with an offset designed to cause the rear surface of the section 14 to touch or abut the doorjamb when the door is in the closed position. This type of offset doorjamb and door construction is utilized frequently in conjunction with narrow stile aluminum doors of the type found in many retail commercial establishments.

From an examination of FIGS. 1 through 4, it is apparent that the three sections 12, 13 and 14 of the plate 10 all may be formed of a single piece of metal, either pressed to shape from a flat plate of stock material or from a metal extrusion cut to the desired vertical length. Because of the features of the protective plate 10, it is possible to form the sections 12, 13 and 14 from a single aluminum extrusion of approximately ¼ inch thickness. Even though aluminum is not as strong as stainless steel, the features of the device permit the use of aluminum for an effective protective device, where formerly only expensive stainless steel plates could be used.

The section 12 has a circular hole 23 in it to closely fit over the protruding portion of a lock cylinder 25 mounted in a conventional manner in the door frame 16. As is well known, cylinder locks of the type which are commercially available have a portion which extends outwardly from the door to a distance of approximately ⅛ inch to ¼ inch. As a consequence, the cylinder is exposed; and it may be gripped by conventional tools and twisted or pulled out of the door. By seating the cylinder 25 in the circular opening 23, a flush or nearly flush surface is provided by the face of the section 12 and the exposed portion of the cylinder 25; so that it is not possible to grip an exposed portion of the cylinder 25 when the plate 12 is attached to the door 16. As also illustrated in FIG. 1, a door 16 of the type with which the protective device 10 most commonly is used, has a plate glass window section 17 in the central portion.

The plate 12 is attached to the door frame 16 by drilling holes through the door frame to register with corresponding holes in the plate 12. Carriage bolts 20 and 21 then are passed from the surface of the plate 12 shown in FIG. 1 through the door 16 and are attached on the rear side by means of fasteners 22 (See FIGS. 4 and 5). The fasteners 22 illustrated in FIGS. 4 and 5 constitute a conventional nut (FIG. 4) or a conventional cap nut (FIG. 5). Other types of fasteners may be employed, so long as the portion which is on the outside of the section 12, as illustrated in FIG. 1, is not accessible for removal by any tools. Carriage bolts are a typical way of accomplishing the desired result at a relatively low cost. The installation of the device 10 by bolting it in place with the carriage bolts 20 and 21 to the door 16, is permanent throughout the use of the device. The device 10 remains in place at all times.

The offset or bridge 13 covers the gap between the edge of the door 16 and the edge of the doorjamb where the bolt of the cylinder lock 25 enters the strike hole (not shown) in the doorjamb. This prevents potential burglars from having access to this area of the lock. The vertical height of the sections 12, 13 and 14 is selected to extend several inches above and below the bolt, so that it is not possible to fit a crow bar into the space between the door and doorjamb anywhere near the region of the bolt. This significantly improves the integrity of the lock when the device is in place.

Protective cover plates which overlap the doorjamb and the space between the door and the doorjamb, however, have been used in the past, as described above. These plates still do not provide the maximum degree of security since they do not secure the portion, such as the section 14, which overlaps the doorjamb to the doorjamb itself. Some prior art devices use pins which enter holes in the doorjamb to prevent relative movement of the door and doorjamb in planes parallel to the cover plate. If a potential burglar can get a prying tool behind the plate, however, it is possible to pry the plate away from the doorjamb outwardly since such pins do not secure the plate to the doorjamb.

The device shown in FIGS. 1 through 4 includes a positive auxiliary securing lock for removably attaching the section 14 directly to the doorjamb to prevent a pulling away of the plate 14 from the doorjamb, as well as to prevent a parting of the door and the doorjamb from one another by means of a crow bar or pry bar placed between the door and doorjamb. This auxiliary lock is in the form of a conventional spring-loaded cylindrical lock 31 of the type commonly used for activating and deactivating burglar alarms, for instance.

Rotation of a key 29 in the lock 31 serves to rotate a member 35 relative to an outer housing 34. Typically the housing 34 has flattened sides and is secured to the back side of the location where it is used by means of a threaded nut. The lock 31 as used in the embodiment of FIGS. 1 through 4, however, is not secured to the plate 14. It is simply slip fitted into an elongated or oval opening 30 in the plate 14 (most clearly shown in FIG. 3), so that the flattened sides of the housing 34 engage the flattened sides of the opening 30 to prevent rotation of the housing 34 when the member 35 is rotated by the key 29. Instead of the conventional operating mechanism normally attached to the rotatable member 35, an elongated rod 37, typically made of steel, is secured at it's left end (as viewed in FIGS. 2 and 3) to the portion 35. The right end of the rod 37 is externally threaded, as shown at 38, to engage a corresponding internally threaded hole 42 in a cover plate 41 placed on the other side of the doorjamb 28. The doorjamb 28 typically is a hollow metal doorjamb, and a circular hole 32 is formed in the front face and is aligned with a corresponding circular hole 39 in the rear face of the doorjamb 28. These holes are shown most clearly in Figure 2.

A short hollow tube or cylinder 40 with a flared end is inserted through the hole 39 to rest in the hole 32, as shown in FIG. 2, for the purpose of accomodating the shaft 37 and other portions of the lock mechanism. Once the tube 40 is in place, a cover plate 41, having an undercut portion in it around the flared end of the tube 40 and over the hole 39, is secured to the doorjamb 28 by means of a pair of threaded fasteners 45 and 46, as illustrated in FIGS. 2 and 3.

Figure 5:
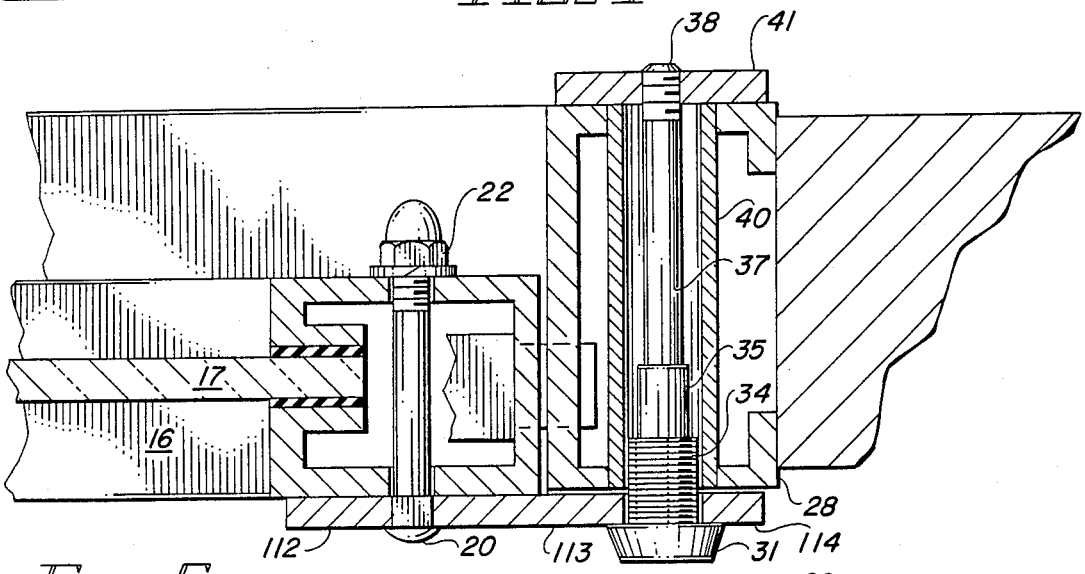
FIG. 5 is a cross section of an alternative embodiment taken at a point comparable to the cross section of FIG. 4.

When the door 16 is in normal use, the lock 31 and the attached rod 37 are removed as shown in FIG. 4. The door 16 then can be opened and closed in it's normal manner. At the end of the day, or whenever the cylinder lock 25 is used to lock the door, the relative position of the cover plate sections 12, 13 and 14 are as shown in FIG. 4. The lock 31 and the attached rod 37 are then inserted through the hole 30 and into the tube 40 to cause the end 38 to engage the mating threaded hole 42 in the plate 41. This is most readily understood by a reference to FIGS. 2 and 4. The key 29 then is used to turn the shaft 37 and thread the portion 38 into engagement with the plate 41 through the hole 42. A small number of turns of the key 29 are used to effect this until the outer flange on the portion 31 is drawn tightly into engagement with the outer surface of the section 14. This holds the entire assembly together in compression between the plate 41 on the rear surface of the doorjamb 28 and the section 14 overlying the front surface of the doorjamb. The key 29 then is removed; and the protective plate 10 comprising the sections 12, 13 and 14 is positively secured to the doorjamb 28, as well as to the door 16. The secured position is illustrated in FIG. 2 and also in FIG. 5, which depicts another variation or alternative embodiment of the invention.

When the door 16 is to be opened, the key 29 is inserted into the lock 31 and rotated in the opposite direction to disengage the end 38 of the rod 37 from the hole 42. Once this has been effected the entire auxiliary assembly lock, comprising the lock 31, the body 34, member 35 and the rod 37, is removed as shown in FIG. 4 to permit normal operation of the door.

The tube 40 is provided to prevent vandals or pranksters from locking persons into the building by the insertion of a hook or other device through the holes 30 and 31 to hang downwardly into the hollow interior of the doorjamb 28. The interior surface of the cylinder 40 prevents this and provides an important safety feature. The tube 40 is not otherwise necessary for effecting the operation of the auxiliary lock to secure the plate section 14 to the doorjamb 28.

Figure 6:
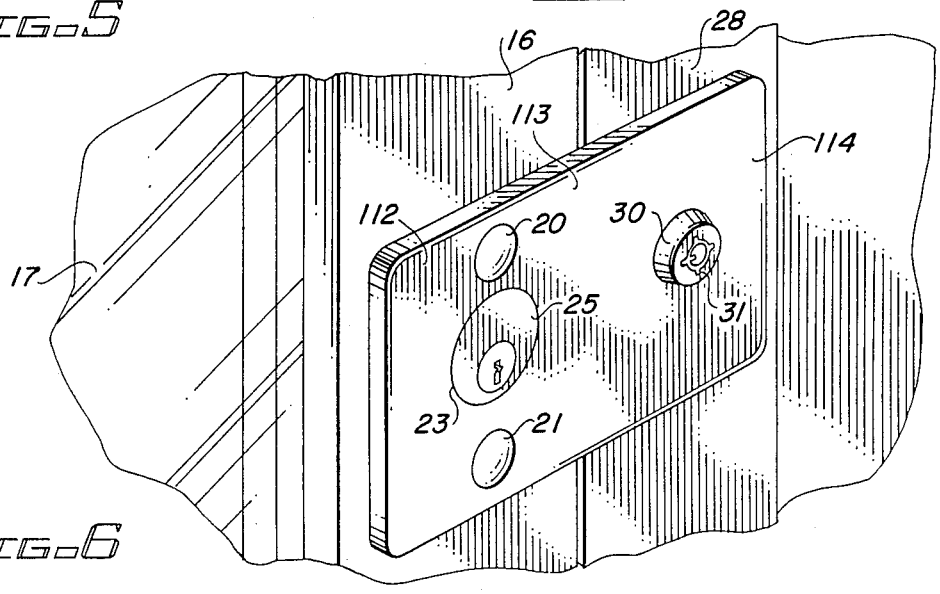
FIG. 6 is a perspective view of the alternative embodiment shown in cross section in FIG. 5.

FIGS. 5 and 6 illustrate another variation of the invention for use where the doorjamb 28 and the door 16 are not offset from one another in the closed position. A flat plate 10 then may be used with three portions or sections 112, 113 and 114 all formed from a single flat piece of material. The portion 112 corresponds to the portion 12 of FIG. 1, the central portion 113 corresponds to the offset bridge portion 13 of FIG. 1 and the right-hand portion 114 corresponds to the portion 14 of FIG. 1. These three sections or portions of the embodiment of FIGS. 5 and 6 function in the same manner as the sections 12, 13 and 14 described previously in conjunction with FIGS. 1 through 4. The manner in which this flat plate embodiment is installed is clearly shown in the perspective view of FIG. 6 and the cross sectional view of FIG. 5.

The foregoing description of the preferred embodiments should be considered as illustrative of the invention and not as limiting. For example, different types of fasteners may be employed in place of the carriage bolts 20 and 21. The relative dimensions and materials used can be changed in accordance with different desired characteristics or installation situations. The type of lock 31 which is used to secure the plates 14 and 114 to the doorjamb 28 may be changed, although the one shown is readily available commercially. Other changes and modifications will occur to those skilled in the art without departing from the true scope of the invention.

I claim:

1. A guard for protecting a door from forced entry where the door is used in conjunction with a doorjamb, with a lock cylinder in the door operatively interconnected with a reciprocal bolt for entering an opening in the doorjamb, said guard including in combination:

a plate having first and second interconnected sections, with an opening in each of said first and second sections thereof, the opening in said first section of said plate for accommodating the portions of a door lock cylinder which are exposed on the surface of a door in which such lock cylinder is mounted;

means for securing said first section of said plate to a door having a lock cylinder mounted therein, with the lock cylinder aligned with the opening in said first section;

bridging means interconnecting said first and second sections of said plate to cause said second section to overlie a doorjamb when the door to which said first section is secured is closed, said bridging means overlying the space between the door and the doorjamb when the door is closed;

auxiliary securing means for mounting in the opening in said second section for releasably securing said second section to the doorjamb independently of operation of the lock cylinder.

2. The combination according to claim 1 wherein said plate is a metal plate.

3. The combination according to claim 2 wherein said first and second sections are elongated rectangular sections.

4. The combination according to claim 3 wherein an opening is provided through the doorjamb in alignment with the opening in said second section, with said first section of said plate secured to the door, and when the door is closed.

5. The combination according to claim 4 further including a backing plate mounted on the doorjamb opposite the side overlaid by said second section and located in alignment with the opening through said doorjamb, and wherein said auxiliary securing means comprises means for pulling together said backing plate and said second section, said pulling together means extending through the opening in said second section and the opening through said doorjamb for engaging said backing plate.

6. The combination according to claim 5 wherein said auxiliary securing means comprises auxiliary lock means having a rotatable member therein capable of rotation by a key; a longitudinal shaft attached to the rotatable member of said auxiliary lock means for extending into and engaging a mating portion of said backing plate to secure said second section to said backing plate when said auxiliary lock means is operated in a first manner and to release said second section from said backing plate when said auxiliary lock means is operated in a second manner.

7. The combination according to claim 4 wherein said first and second sections of said plate lie in different parallel planes corresponding, respectively, to the plane of the surface of the door to which said first section is secured and the plane of the doorjamb.

8. The combination according to claim 7 wherein said plate is a metal plate, the first section of which at least has a thickness which is substantially equal to or greater than the distance which the lock cylinder extends outwardly from the surface of the door in which the lock cylinder is mounted.

9. The combination according to claim 4 wherein said first and second sections of said plate are in the same plane and said bridging means is integrally formed with said first and second sections to form a single unitary plate therewith.

10. The combination according to claim 9 wherein said plate is a metal plate, the first section of which at least has a thickness which is substantially equal to or greater than the distance which the lock cylinder extends outwardly from the surface of the door in which the lock cylinder is mounted.

11. The combination according to claim 1 wherein said first and second sections of said plate lie in different parallel planes corresponding, respectively, to the plane of the surface of the door to which said first section is secured and the plane of the doorjamb.

12. The combination according to claim 1 wherein said first and second sections of said plate are in the same plane and said bridging means is integrally formed with said first and second sections to form a single unitary plate therewith.

13. The combination according to claim 1 wherein an opening is provided through the doorjamb in alignment with the opening in said second section, with said first section of said plate secured to the door, and when the door is closed.

14. The combination according to claim 13 further including a backing plate mounted on the doorjamb opposite the side overlaid by said second section and located in alignment with the opening through said doorjamb, and wherein said auxiliary securing means comprises means for pulling together said backing plate and said second section, said pulling together means extending through the opening in said second section and the opening through said doorjamb for engaging said backing plate.

15. The combination according to claim 14 wherein said auxiliary securing means comprises auxiliary lock means having a rotatable member therein capable of rotation by a key; a longitudinal shaft attached to the rotatable member of said auxiliary lock means for extending into and engaging a mating portion of said backing plate to secure said second section to said backing plate when said auxiliary lock means is operated in a first manner and to release said second section from said backing plate when said auxiliary lock means is operated in a second manner.

16. The combination according to claim 1 wherein said first and second sections are elongated rectangular sections.

17. The combination according to claim 16 wherein said first and second sections of said plate lie in different parallel planes corresponding, respectively, to the plane of the surface of the door to which said first section is secured and the plane of the doorjamb.

18. The combination according to claim 17 wherein said bridging means comprises a unitary interconnecting member in a plane perpendicular to the planes of said first and second sections to offset said first and second sections from one another by a distance equal to the distance which the door is inset from the outer edge of a doorjamb when the door is closed.

19. The combination according to claim 18 wherein said plate is a metal plate.

* * * * *